US010427446B2

(12) United States Patent
Staub et al.

(10) Patent No.: US 10,427,446 B2
(45) Date of Patent: Oct. 1, 2019

(54) TRANSFER FILM AND METHOD FOR PRODUCING A TRANSFER FILM

(71) Applicant: OVD Kinegram AG, Zug (CH)

(72) Inventors: Rene Staub, Hagendorn (CH); Christina Streb, Abtwil (CH); Michael Hoffmann, Walchwil (CH); Reto Gnos, Attinghausen (CH)

(73) Assignee: OVD KINEGRAM AG, Zug (CH)

( * ) Notice: Subject to any disclaimer, the term of this patent is extended or adjusted under 35 U.S.C. 154(b) by 0 days.

(21) Appl. No.: 15/504,836

(22) PCT Filed: Aug. 11, 2015

(86) PCT No.: PCT/EP2015/068423
§ 371 (c)(1),
(2) Date: Feb. 17, 2017

(87) PCT Pub. No.: WO2016/026731
PCT Pub. Date: Feb. 25, 2016

(65) Prior Publication Data

US 2017/0267013 A1 Sep. 21, 2017

(30) Foreign Application Priority Data

Aug. 22, 2014 (DE) ..... 10 2014 112 073

(51) Int. Cl.
*B42D 25/328* (2014.01)
*B42D 25/425* (2014.01)
(Continued)

(52) U.S. Cl.
CPC ..... *B42D 25/378* (2014.10); *B41M 3/12* (2013.01); *B41M 3/148* (2013.01); *B42D 25/29* (2014.10);
(Continued)

(58) Field of Classification Search
CPC ..... B42D 25/328; B42D 25/425; B42D 25/47
See application file for complete search history.

(56) References Cited

U.S. PATENT DOCUMENTS 7,040,663 B1 5/2006 Plaschka et al.
8,691,493 B2 4/2014 Brehm et al.
(Continued)

FOREIGN PATENT DOCUMENTS

DE 19907697 8/2000
DE 102009033762 1/2011
(Continued)

OTHER PUBLICATIONS

WO-2012000631-A2 Translation (Year: 2012).*
Japanese Office Action dated Mar. 5, 2019.

*Primary Examiner* — Kyle R Grabowski
(74) *Attorney, Agent, or Firm* — Hoffmann & Baron, LLP

(57) ABSTRACT

The invention relates to a transfer film (1), in particular hot-stamping film, the use of a transfer film (1), a film, a security document (2), and a method for producing a transfer film (1). Here, it is provided that the transfer film (1) comprises a transfer layer (20) detachably arranged on a carrier layer (10). The transfer layer (20) further has at least one first color layer (30) and the at least one first color layer (30) comprises at least one binder and at least first pigments, the color appearance of which changes depending on the observation angle.

40 Claims, 8 Drawing Sheets

(51) Int. Cl.

| | |
|---|---|
| ***B42D 25/47*** | (2014.01) |
| ***B42D 25/378*** | (2014.01) |
| ***B41M 3/12*** | (2006.01) |
| ***B44F 1/14*** | (2006.01) |
| ***B42D 25/36*** | (2014.01) |
| ***B42D 25/29*** | (2014.01) |
| ***B42D 25/455*** | (2014.01) |
| ***B42D 25/46*** | (2014.01) |
| ***B42D 25/364*** | (2014.01) |
| ***B41M 3/14*** | (2006.01) |
| ***B44C 1/17*** | (2006.01) |
| ***B42D 25/369*** | (2014.01) |
| ***B42D 25/382*** | (2014.01) |
| ***B42D 25/387*** | (2014.01) |

(52) U.S. Cl.

CPC ..... *B42D 25/328* (2014.10); *B42D 25/36* (2014.10); *B42D 25/364* (2014.10); *B42D 25/369* (2014.10); *B42D 25/382* (2014.10); *B42D 25/387* (2014.10); *B42D 25/425* (2014.10); *B42D 25/455* (2014.10); *B42D 25/46* (2014.10); *B42D 25/47* (2014.10); *B44C 1/1729* (2013.01); *B44F 1/14* (2013.01)

(56) References Cited

U.S. PATENT DOCUMENTS

| | | | | |
|---|---|---|---|---|
| 8,993,103 | B2 | 3/2015 | Clauter et al. | |
| 9,321,294 | B2 | 4/2016 | Scheuer | |
| 2007/0211238 | A1* | 9/2007 | Hoffmuller | B42D 25/373 356/71 |
| 2009/0250158 | A1 | 10/2009 | Streb et al. | |
| 2011/0115212 | A1* | 5/2011 | Hoffmuller | B42D 25/328 283/85 |
| 2012/0122121 | A1 | 5/2012 | Bleikolm et al. | |
| 2012/0133121 | A1 | 5/2012 | Bleikolm et al. | |
| 2013/0167355 | A1 | 7/2013 | Lutz et al. | |
| 2014/0346766 | A1 | 11/2014 | Walter et al. | |
| 2016/0214362 | A1 | 7/2016 | Takahashi et al. | |

FOREIGN PATENT DOCUMENTS

| | | | | |
|---|---|---|---|---|
| DE | 102010054528 | | 6/2012 | |
| DE | 102011119598 | | 5/2013 | |
| DE | 102012001121 | | 7/2013 | |
| EP | 1832439 | | 9/2007 | |
| JP | S54182392 | | 12/1979 | |
| JP | 2004268502 | A | 9/2004 | |
| JP | 2006281518 | A | 10/2006 | |
| JP | 2010194722 | A | 9/2010 | |
| WO | WO2011012520 | | 2/2011 | |
| WO | WO2012000631 | | 1/2012 | |
| WO | WO-2012000631 | A2 * | 1/2012 | B44C 1/1729 |

* cited by examiner

TRANSFER FILM AND METHOD FOR PRODUCING A TRANSFER FILM

This application claims priority based on an International Application filed under the Patent Cooperation Treaty, PCT/EP2015/068423, filed on Aug. 11, 2015, and German Application No. DE 102014112073.6, filed on Aug. 22, 2014.

BACKGROUND OF THE INVENTION

The invention relates to a transfer film, in particular hot-stamping film, the use of a transfer film, a film, a security document, and a method for producing a transfer film.

Security documents such as for example banknotes, passports, ID cards, check cards, credit cards, visas or certificates are often provided with security elements to increase protection against forgery. Such security elements are used to check security documents for authenticity and allow forgeries or manipulations to be recognized. Furthermore, security elements on security documents increase protection against illegal duplication. Such security elements are moreover used in the field of commercial products or product packaging, the authenticity of which is to be verified.

Security elements often have light-bending, diffractive structures such as for example holograms which, after application to a security document, are intended to increase its protection against forgery. These security elements offer the observer striking optically variable effects. In addition to the already-mentioned security elements which are based on optically diffractive effects, optically variable thin-film-layer elements are often used, which give an observer a different color impression for example, at different observation angles. Such thin-film-layer elements are based on interference effects.

Security elements with, for example, diffractive structures are often transferred onto the security documents to be protected by means of transfer methods. For this, a transfer layer is transferred, for example under the action of heat and pressure, from a carrier film onto a target substrate to which the transfer layer adheres, using an adhesive layer.

In contrast, further security features which also increase the protection of the security documents against forgery, such as for example optically variable effect colors or soluble dyes, are printed directly onto the target substrate. For this, the screen printing method is usually used, in which in particular the achievable brilliance and the distinctiveness of the color effects depend on the nature of the target substrate. The target substrate can be in the form of sheets or as a roll.

SUMMARY OF THE INVENTION

The object of the invention now is to provide a transfer film which avoids the disadvantages of the state of the art.

Such a transfer film, in particular hot-stamping film, comprises a transfer layer detachably arranged on a carrier layer, wherein the transfer layer has at least one first color layer and wherein the at least one first color layer comprises at least one binder and at least first pigments, the color appearance of which changes depending on the observation angle. In such a method for producing a transfer film, a carrier layer is provided in the method, which has a transfer layer, wherein at least one first color layer is applied to the side of the transfer layer facing away from the carrier layer, wherein the at least one first color layer comprises at least one binder and at least first pigments, the color appearance of which changes depending on the observation angle.

The transfer layer which comprises the at least one first color layer can be transferred from the carrier layer onto a target substrate, such as for example a security document, by means of a stamping process. The widespread stamping technique, in particular hot stamping or cold stamping, can hereby be used in order to apply the transfer layer to the security document. The protection of the security document against forgery is hereby further increased, as an additional hard-to-forge layer with a color appearance dependent on the observation angle is applied without, however, a corresponding printing process being necessary. This makes a reduction in costs possible as, instead of a complex printing technique, the stamping technique can be used for application of the stamping film. Unlike screen printing, the stamping technique is a dry process, with the result that possible stresses due, for example, to solvents, the use of which can possibly be limited by country-specific environmental laws and by lack of an infrastructure, are eliminated. Furthermore, the influence of the surface of the target substrate, such as for example the roughness, is reduced as, during the production of the transfer film, is printed onto a known material, in particular onto the carrier film, with determinable properties, whereby the pigments are better oriented and the optical effect is thereby improved. The inter-layer bonding in the area of the color layer can also be improved by a suitable choice of material of the corresponding transfer layers.

By "the at least first pigments, the color appearance of which changes depending on the observation angle" is here meant in particular pigments which produce a color effect due to interference effects, which is dependent on the observation angle. In order to produce such a color-change effect with a high degree of brilliance, the pigments must have a similar orientation to each other. Such pigments are for example optically variable pigments (OVPs).

By a "binder" is here meant a liquid material which contains various pigments and which can be transferred together with the pigments by means of a printing process. Such combinations of binders and pigments are for example optically variable inks (OVI®s) which, in particular by interference effects, produce an optically variable color impression. OVIs typically have to be printed in significant layer thicknesses in order to produce a recognizable color-change effect with a high degree of brilliance.

By the term "observation angle" is here meant both the angle at which the color layer on the transfer film or the security document is observed by an observer and also the angle at which the color layer on the transfer film or the security document is illuminated by an illumination device. By "observation angle" is meant the angle enclosed between the surface normal of the transfer film or the security document and the observation direction of an observer. By "observation angle" is likewise meant the angle enclosed between the surface normal of the transfer film or the security document and the illumination direction of an illumination device. Thus for example at an observation angle of 0° an observer looks at the surface of the transfer film or the security document perpendicularly, and at an observation angle of 70° an observer looks at the transfer film or the security document at a shallow angle. Thus for example, at an observation angle of 45° an illumination device illuminates the surface of the transfer film or the security document at an acute angle. If the observation direction of the observer or the illumination direction of the illumination device changes, the observation angle consequently changes.

Further advantageous embodiments of the invention are referred to in the dependent claims.

According to a further preferred embodiment example of the invention, the first pigments have a diameter between 1 μm and 100 μm, preferably between 5 μm and 50 μm, and a thickness between 0.1 μm and 5 μm, preferably between 0.3 μm and 2.5 μm.

Furthermore, it is possible that the at least one first color layer contains second pigments, in particular flakes, taggants and/or charms. The protection against forgery of a security document comprising the transfer layer is hereby improved, as such a color layer can be imitated only with difficulty.

By "flakes" is here meant multi-layer flakes which produce a color change dependent on the viewing angle, for example from green to violet.

By "taggants" is here meant marking substances which are not recognizable to the naked human eye, but can be detected with various other determination methods. Examples of this are photochromic, thermochromic, luminescent and magnetic marking substances. Thus, for example, thermochromic marking substances change the color appearance in the case of changes in temperature. By "taggants" is here also meant further marking substances which can be detected for example by means of a spectral analysis, a biochemical analysis or by means of forensic analysis methods.

By "charms" is here meant pigments which exhibit patterns, motifs and/or signs.

According to a further preferred embodiment example of the invention, the at least one first color layer contains third pigments which, in the case of irradiation with electromagnetic radiation, in particular irradiation with UV or IR light (UV=ultraviolet; IR=infrared), emit light from the wavelength range visible to the human eye, in particular in the wavelength range from 400 nm to 800 nm. The protection against forgery of a security document comprising the transfer layer is hereby improved, as such a color layer can be imitated only with difficulty.

The proportion of the at least first pigments in the at least one binder of the at least one first color layer is preferably less than 50%, preferably less than 30%, further preferably less than 15%.

It is further possible that the at least one first color layer contains soluble dyes in the at least one binder. The color-change impression of the color layer for example can be influenced hereby. Thus, for example, a color change from green to brown produced by the first pigments in the at least one first color layer can be influenced by the fact that the at least one first color layer contains soluble dyes, which additionally stain the layer green and thereby intensify the green color impression at a first observation angle and leave the brown color impression unchanged at a second observation angle.

It is further advantageous if the first pigments are formed as flakes and exhibit a substantially similar orientation to each other with respect to the surface normal established by the plane spanned by the transfer layer. A high degree of brilliance of the optically variable effect is hereby achieved.

The orientation of the first pigments with respect to the surface normal established by the plane spanned by the transfer layer and a coordinate system spanned by the transfer layer is preferably locally varied. Interesting and striking optical effects are hereby achieved and the protection against forgery of a security document which comprises the transfer layer is thus increased. Such a variation in the orientation can for example be achieved by changing the parameters of the printing process. For example an orientation of the first pigments can take place during the printing process, in that a print roller has an additional macroscopic surface relief which, during printing, deforms the material to be printed and/or the pigments in the not-yet-fixed binder. The use of a reactive binder can for example be advantageous for this. The reactive binder is here fixed by electromagnetic radiation, in particular by irradiation with UV light, and the orientation of the first pigments is thus likewise fixed. A further possibility for locally varying the orientation of the first pigments is, for example, the use of magnetic pigments.

It is further possible that the first pigments are magnetic and/or have one or more metal layers. It is hereby possible, for example, to vary the pigments locally as described above. The magnetic pigments can here be orientated, for example by means of a correspondingly formed magnetic field in which the transfer film with the color layer comprising the pigments is situated. After the corresponding orientation of the pigments, the binder can here for example be fixed as described above for example by means of UV light.

According to a preferred embodiment example of the invention, the at least one first color layer is present in at least one first area of the transfer layer and not present in at least one second area of the transfer layer. It is for example possible hereby that the at least one first color layer is present in the several first areas and is not present in the at least one second area of the transfer layer. There can thus be for example a plurality of first areas, in which the at least one first color layer is present, wherein the first areas are enclosed by a second area. It is further possible that the at least one second area of the transfer layer encloses the at least one first area of the transfer layer.

It is thus possible that a large surface area of the transfer film can be printed with the at least one first color layer, as the first areas can be applied at a slight distance from each other. The second areas correspondingly occupy a small surface area of the transfer film. The surface of the transfer layer of the transfer film can hereby be optimally utilized in one printing step. A reduction in costs can hereby be achieved as, in particular in the field of high security, such as for example in the case of banknotes, OVIs used are expensive. Likewise, during application of the at least one first color layer, the document layout of the security document need not be taken into consideration, as the transfer layer comprising the at least one first color layer is only later transferred to the desired location on the security document by means of stamping onto the target substrate. The process of transfer onto the security document is hereby simplified, as no printing needs to be carried out on the security document. Furthermore, this makes an increase in productivity possible as, during application of the transfer layers to the security document, the slow screen printing process with the typically small printing areas per surface unit on the security document is replaced by a stamping process. The costs are hereby further reduced as, on the one hand, the complex printing process is avoided and, on the other hand, the wastage—for example due to defective printing onto the security documents—is reduced. Furthermore, possible printing errors can already be detected at an early stage during checking of the transfer film and correspondingly eliminated, before the transfer layer is transferred onto the security document. Wastage in the case of security documents and the costs can hereby be further reduced. Detected printing errors can for example be eliminated by separating out entire film rolls provided with the transfer films or by skipping individual defective transfer films on the rolls comprising the transfer films during application of the transfer layer to the security document.

By "area" is here meant a defined surface area which, in the case of perpendicular observation of the transfer film, i.e. at an observation angle of 0°, is occupied by an applied layer. Thus for example the color layer forms an area which occupies a defined surface area in the case of perpendicular observation of the transfer film. In further areas, further layers can be applied, such as for example a metal layer or a further print which, for example, consists of a fine-line security print, e.g. of fine guilloches.

The at least one first color layer is preferably applied by means of screen printing. It is further possible that the at least one first color layer is applied by means of further processes, such as for example intaglio printing, flexographic printing, pad printing or relief printing.

The at least one first area preferably represents a first item of information, in particular in the form of a pattern, motif or a logo. It is thus possible that the at least one first area is formed patterned. It is thus possible that the shaping of the first area forms an item of information. Such an item of information can for example be a logo formed from letters. The protection against forgery of a security document to which the transfer layer is applied is hereby further increased, as specifically for example logos appear differently colored to the observer at different observation angles.

It is further advantageous that the transfer layer has a first compensation layer which overlaps the at least one first area of the transfer layer and the at least one second area of the transfer layer. It is hereby possible at least partially to compensate for the layer thicknesses of the color layer that are typically thick in comparison with other layers of the transfer film or for example layers with diffractive structures, which are required for a high degree of brilliance of the desired optically variable effect, and to stabilize the transfer layer overall.

It is further possible that the layer thickness of the first compensation layer is less than the layer thickness of the at least one first color layer, in particular that the layer thickness of the first compensation layer lies in the range of from 10% to 50% of the layer thickness of the at least one first color layer.

It has surprisingly been shown that, in spite of the small layer thickness of the compensation layer in comparison with the color layer, the compensation layer still exhibits a stabilizing effect. Furthermore, the smallest possible layer thickness of the transfer layer is hereby achieved. This is particularly advantageous, as the thickness of the security document onto which the transfer layer is transferred changes only slightly by the applied transfer layer. Furthermore, the stamping process can hereby be improved, as thinner transfer layers can typically be severed better.

The layer thickness of the first compensation layer in the at least one second area of the transfer layer advantageously at least corresponds to the layer thickness of the at least one first color layer in the at least one first area of the transfer layer. It is hereby ensured, for example, that the areas in which the color layer is not applied are filled in. This contributes to further stabilization of the transfer layer.

By "stabilization of the transfer layer", in particular "mechanical stabilization of the transfer layer", is here meant that the hardness and strength of the transfer layer are increased. Thus the stabilizing effect of, for example, layers of polycarbonate, in particular at increased temperatures at which polycarbonate layers are laminated, is low, as these exert low resistance vis-à-vis deformation. On the other hand, chemically cross-linked layers of acrylates have a stabilizing effect due to their relatively high strength.

It is further advantageous that the first compensation layer has a layer thickness in the at least one second area of the transfer layer which exceeds the layer thickness of the at least one first color layer in the at least one first area, and that the first compensation layer completely covers the at least one first area. It is hereby achieved that the compensation layer completely covers the color layer and the stability of the transfer layer is thereby further improved. A stabilization of the transfer layer can however also be achieved as described above by the application of compensation layers which have clearly smaller layer thicknesses than the at least one first color layer.

It has surprisingly been shown that the optically variable effect, in the form of the different color appearance in the case of different observation angles after the transfer onto a target substrate such as for example a security document, is clearly more pronounced compared with a direct printing onto the target substrate. By the transfer of further layers, such as the compensation layer, the stability of the transfer layers is improved, with the result that the orientation of the pigments with respect to each other is improved, whereby the brilliance of the color-change effect is improved. The reason for this is that the compensation layer compensates for the roughness of the surface of the target substrate and/or, due to the mechanical stability, reduces the effect of the roughness of the surface on the transfer layer. In particular, if the target substrate, such as for example a plastic layer made of polycarbonate, to which the transfer layer is applied, is laminated with a further plastic layer, a dearly better pronounced color-change effect is achieved compared with direct printing onto the target substrate. The lamination takes place at high temperatures and pressures, whereby the plastic becomes soft and the color layer with the pigments contained therein is deformed. The orientation of the pigments within the color layer is hereby changed and consequently the color-change effect reduced. Through the compensation layer, the color layer is now stabilized, with the result that after the lamination process the pigments are still oriented similarly to each other and the brilliance of the optically variable effect is thereby optimized. Furthermore, it is possible that different layer thicknesses of the at least one first color layer are compensated by such a compensation layer. Fluctuations in the layer thickness of the color layer can for example be compensated hereby, with the result that a flat surface is formed by the compensation layer with respect to a coordinate system spanned by the transfer layer.

It can further be provided that the first compensation layer and/or the second compensation layer comprises fourth pigments which, in the case of irradiation with UV light or IR light, emit light from the wavelength range visible to the human eye.

It is further advantageous that at least one second color layer is present in at least one third area of the transfer layer and is not present in at least one fourth area of the transfer layer, wherein the at least one third area of the transfer layer overlaps the at least one first area of the transfer layer or the at least one third area of the transfer layer does not overlap the at least one first area of the transfer layer. It is hereby possible, for example to transfer color layers having two different color-change effects with the transfer layer by means of a single stamping process. The protection against forgery is here further increased, wherein the processing advantages of the stamping technique are preserved.

It is further possible that the transfer layer has a second compensation layer which, in the at least one fourth area of the transfer layer, at least corresponds to the layer thickness of the at least one second color layer in the at least one third area of the transfer layer.

Preferably, the first compensation layer and/or the second compensation layer has a layer thickness between 3 μm and 50 μm, preferably 5 μm and 25 μm, further preferably 7 μm and 20 μm. It hereby becomes possible that the typically thick layer thicknesses of the color layer, which are required for a high degree of brilliance of the desired optically variable effect, can be compensated by the compensation layers.

It is further possible that the first compensation layer and/or the second compensation layer has a layer thickness between 0.5 μm and 15 μm, preferably from 0.5 μm to 7.5 μm, further preferably from 1.5 μm to 5 μm. Such layer thicknesses are, as described above, smaller than the layer thickness of the at least one first color layer and nevertheless achieve a stabilizing effect.

It is further advantageous if the first compensation layer and/or the second compensation layer are transparent and/or colorless. It is hereby possible to observe the color layers through the compensation layers and/or to recognize the target substrate through the compensation layers.

Preferably, the first compensation layer and/or the second compensation layer is formed as a bonding layer, in particular adhesive layer. It is hereby possible that the compensation layer, in addition to the function of compensating for the roughness of the surface of the target substrate and/or of compensating for the layer thicknesses, caused in particular by the required thicknesses of the color layer, furthermore takes on the function of a bonding layer, with which the transfer layer is applied to a target substrate.

According to a further preferred embodiment example of the invention, the transfer layer has a first bonding layer on the surface facing away from the carrier layer.

By a "bonding layer" is here meant a layer which connects layers between which the bonding layer is arranged. It is thus possible that the bonding layer is an adhesive layer.

It is further advantageous that the bonding layers, in particular adhesive layers, comprise for example acrylates, PVC, polyurethane or polyester.

According to a further preferred embodiment example of the invention, the at least one first color layer has a thickness between 3 μm and 30 μm, preferably 5 μm and 15 μm. It is hereby achieved that the optically variable effect of the color layer is particularly pronounced or achieves a high degree of brilliance.

Preferably, further color layers, such as for example a second color layer and/or a third color layer, have a thickness between 3 μm and 30 μm, preferably 5 μm and 15 μm.

According to a further embodiment example of the invention, the transfer layer has at least one first stabilizing layer which mechanically stabilizes the transfer layer. The transfer layer is hereby further stabilized and the brilliance of the color-change effect is further improved after a transfer onto a target substrate. Furthermore, it is possible that the first stabilizing layer serves as a protective layer, in particular as a protective layer vis-à-vis solvents or mechanical damage.

Preferably, the at least one first stabilizing layer is arranged between the carrier layer and the at least one first color layer.

It is further possible that a second stabilizing layer is applied to the side of the at least one first color layer facing away from the at least one first stabilizing layer. The transfer layer, in particular for transfer layers with a large surface area, is hereby further stabilized and the brilliance of the color-change effect is further improved after transfer onto a target substrate.

It is further advantageous that the at least one first stabilizing layer is applied to the side of the at least one first color layer facing away from the carrier layer.

Preferably, the at least one first stabilizing layer and/or the second stabilizing layer has a layer thickness between 0.2 μm and 7.5 μm, preferably 0.4 μm and 5 μm, further preferably 0.6 μm and 4 μm. By means of such layer thicknesses, a sufficient stabilizing effect is achieved, with the result that the optically variable effect of the color layer in the transfer layer is improved in comparison with a direct printing of the color layer.

It is further possible that the at least one first stabilizing layer and/or the second stabilizing layer is cross-linked, in particular chemically and/or by irradiation with UV light and/or irradiation with electron beams. For example, layers comprising acrylates, polyester, polyvinyl alcohols or alkyd resins are chemically cross-linked by means of isocyanate. Furthermore, layers comprising polymethyl acrylate, dipentaerythriol pentaacrylates or polysiloxane resin and a photoinitiator such as for example Irgacure are for example cross-linked by means of UV light. Epoxy resins can also be used as chemically cross-linked layers.

It is further advantageous to select the layer thickness of the first and/or second stabilizing layer and/or the materials of the first and/or second stabilizing layer and/or the properties of the first and/or second stabilizing layer depending on the further layers of the transfer layers or of the target substrate. Thus for example a particularly rigid stabilizing layer is advantageous if the further layers of the transfer layers are soft and provide little support. A particularly smooth stabilizing layer is for example to be selected in the case of a high degree of roughness of the target substrate. In particular, target substrates made of polycarbonate can have a roughness in the range of from 10 μm to 20 μm and thereby adversely affect the optical impression of the pigments in the color layer. The influence of the roughness is significantly reduced by the use of a correspondingly formed stabilizing layer.

It is further advantageous if the at least one first stabilizing layer and/or the second stabilizing layer is a layer cured by electromagnetic radiation, in particular by irradiation with UV light.

Preferably, the at least one first stabilizing layer and/or the second stabilizing layer are transparent or translucent.

According to a further embodiment example of the invention, the transfer layer has a primer layer.

Preferably, the at least one first color layer is applied to the primer layer. The inter-layer bonding of the color layer can hereby be set in a targeted manner and thereby improved—for example by optimizing onto the OVI to be imprinted.

It is further possible that the primer layer has a layer thickness between 0.01 μm and 0.5 μm, preferably 0.03 μm and 0.25 μm, further preferably 0.04 μm and 0.08 μm.

According to a further embodiment example of the invention, the carrier layer has a layer thickness between 12 μm and 50 μm, preferably 15 μm and 25 μm. Carrier layers made of PET, PEN, OPP, BOPP, PE or cellulose acetate are to be named as examples of the carrier layer. The carrier layer can also itself comprise several sublayers.

According to a further embodiment example of the invention, the transfer layer comprises a detachment layer which allows the separation of the transfer layer from the carrier layer. Detachment layers made of cellulose butyrate, acrylates, nitrocellulose, ethyl acetate, butyl acetate or styrene copolymer are to be named as examples of the detachment layer. In particular, after transfer of the transfer layer onto a target substrate, the detachment layer, starting from the target substrate, represents the top layer and can fulfil or provide further functions, such as for example overprintability with further layers. In the case of lamination or adhesion of the target substrate with a further film, the detachment layer also serves as bonding layer for binding to the further film applied.

Preferably, the detachment layer has a layer thickness between 0.2 μm and 4 μm, preferably 0.5 μm and 2.5 μm, further preferably 0.8 μm and 2.0 μm.

According to a further embodiment example of the invention, a separating layer, in particular a wax layer, a silicone layer and/or a varnish layer curable by means of UV light or electron beams, is applied to the carrier layer, which separating layer allows the separation of the transfer layer from the carrier layer.

According to a further embodiment example of the invention, the at least one first color layer can have an individual marking. This marking can for example be produced in that the color layer applied is locally removed by means of a laser beam depending on the marking. Such a marking can in particular contain a barcode and/or alphanumeric characters and for example a serial number. Traceability is in particular ensured by this individual marking. A marking can however also be produced by means of a printing process, such as for example by inkjet printing. The marking can take place both in the first areas and also in the further areas and, for example, be visually recognizable or only become visible under UV irradiation. The printing can take place in particular between detachment layer and the at least first color layer or on the side of the at least first color layer facing away from the carrier.

It is further possible that the at least one first color layer forms a raster image.

According to a further embodiment example of the invention, the transfer layer has at least one replication varnish layer. The stability of the transfer layer can be further increased hereby.

It is further possible that a surface structure is molded into the surface of the replication varnish layer in at least one fifth area of the transfer layer. The protection against forgery of a security document comprising the transfer layer is hereby further increased, as a further security element that can only be imitated with difficulty is present.

The surface structure is preferably not molded into the surface of the replication varnish layer in the at least one first area of the transfer layer.

It is further possible that the at least one fifth area of the transfer layer does not overlap with the at least one first color layer. The surface structure in the surface of the replication varnish layer in the at least one fifth area of the transfer layer is thus present only in areas in the transfer film which do not have the at least one first color layer.

It is further advantageous if the refractive index of the replication varnish layer differs from the refractive index of the binder by less than 0.2, preferably by less than 0.1. It hereby becomes possible to eliminate the optically variable effects of the surface structures molded into the surface of the replication varnish layer.

The surface structure is preferably selected from the group of diffractive surface structures, in particular Kinegram® or holograms, zero-order diffraction structures, blazed gratings, in particular linear or crossed sinusoidal diffraction gratings, linear or crossed single- or multi-step rectangular gratings, asymmetrical saw-tooth relief structures, light-diffracting and/or light-refracting and/or light-focusing micro- or nanostructures, binary or continuous Fresnel lenses, binary or continuous Fresnel freeform surfaces, diffractive or refractive macrostructures, in particular lens structures or microprism structures, mirror surfaces and mat structures, in particular anisotropic or isotropic mat structures, or combinations of these structures.

It is further possible that the at least one fifth area of the transfer layer represents a second item of information in the form of a pattern, motif or a logo. The protection against forgery of a security document to which the transfer layers are applied is hereby further increased, as for example the shaping of the at least one fifth area forms a second item of information in the form of a motif.

The replication varnish layer is preferably thermoplastically deformable and/or cross-linked, in particular cross-linked by irradiation with UV light. The stability of the transfer layer can in particular be further increased by cross-linking.

It is further advantageous that the replication varnish layer has a layer thickness between 0.2 μm and 4 μm, preferably 0.3 μm and 2 μm, further preferably 0.4 μm and 1.5 μm.

The transfer layer preferably has a reflecting layer in at least one sixth area of the transfer layer, wherein the surface coverage of the at least one sixth area of the transfer layer, is less than 30%, preferably less than 20%, of the total surface area of the transfer layer. The reflecting layer is preferably a metal layer made of chromium, gold, copper, silver or an alloy of such metals, which is vapor-deposited in a layer thickness of from 0.01 μm to 0.15 μm under vacuum. Such a partial metalization can for example be a metallic nanotext. It is ensured by the surface coverage that the color-change effect of the color layers in the at least one first area and/or at least one third area is not adversely affected by the at least one sixth area.

It is further also possible that the reflecting layer is formed by a transparent reflecting layer, for example a thin or finely structured metallic layer or an HRI (high refraction index) or LRI (low refraction index) layer. Such a dielectric reflecting layer consists, for example, of a vapor-deposited layer made of a metal oxide, metal sulfide, titanium oxide etc. with a thickness of from 10 nm to 150 nm.

It is further possible that the reflecting layer in the at least one sixth area of the transfer layer is applied to the side of the at least one first color layer facing away from the carrier film. It is hereby possible, for example, to superimpose the first area with a metalization. As the color layers are typically applied with large layer thicknesses at each screen printing, a precise printing is made more difficult. It is thus possible to improve the contours of the color layer in the first area of the transfer layers, by for example applying a partial metalization to the color layer which can be applied with great accuracy.

It is further advantageous that the at least one sixth area of the transfer layer represents a third item of information in the form of a pattern, motif or a logo.

It is further advantageous if the transfer layer contains at least one mark in at least one seventh area of the transfer layer for determining the relative location or position of the at least one first area of the transfer layer and/or of the at least one third area of the transfer layer and/or of the at least one fifth area of the transfer layer and/or of the at least one sixth area and/or of the at least one eighth area of the transfer layer. These marks thus represent register marks or registration marks. By "register" or "register accuracy", or "registration" or "registration accuracy" is meant the accurately positioned arrangement of layers that are superimposed or juxtaposed relative to one another, maintaining a desired positional tolerance.

The marks are preferably formed from a printing material, a surface relief, a magnetic or conductive material. The marks can thus for example be optically readable register marks which differ from the background by their color value, their opacity or their reflective properties. The marks can also be macroscopic or diffractive relief structures which deflect the incident light in a predefined angle range and differ optically from the background area through these properties. The register marks can however also be register marks that are detectable by means of a magnetic sensor or a sensor detecting electrical conductivity. The marks are for example detected by means of an optical sensor, a magnetic sensor or a mechanical sensor, a capacitive sensor or a sensor detecting conductivity, and the application of the transfer layer is then controlled by means of the marks.

It is particularly advantageous if the register marks are applied in the same operation in which the at least one color layer is applied. The application takes place in the same operation with the same tool, with the result that registration fluctuations or register fluctuations between motif and register mark are thereby minimized.

According to a further embodiment example of the invention, the transfer layer has a photopolymer layer.

It is further possible that the photopolymer layer has a volume hologram in at least one eighth area of the transfer layer. The protection against forgery of a security document comprising the transfer layer is hereby further increased, as further optical effects are produced.

It is further advantageous that the at least one fifth area of the transfer layer overlaps at least partially with the at least one eighth area of the transfer layer or that the at least one fifth area of the transfer layer does not overlap with the at least one eighth area of the transfer layer.

According to a further embodiment example of the invention, the transfer layer is present in at least one first zone and not present in at least one second zone, wherein the at least one first zone of the transfer layer is formed patterned.

Advantageously the transfer layer here is severed by means of punching along the boundary lines formed by the first and second zones. The transfer layer is here severed by means of a punch which forms the shape of the first zone and the second zone which is not to be transferred is removed. The punching can take place by mechanical action with a punching tool or also be carried out by means of laser processing. Punching is in particular advantageous in the case of non-complex motifs, as significant fraying at the motif edges, which adversely affects the optical appearance, hardly occurs. The surface area of the color layer is, in such a case, typically greater than the motif to be punched out, with the result that the area comprising the color layer completely surrounds the at least one first zone. It is further possible that the at least one first zone completely surrounds the area comprising the color layer, with the result that in this case the motif is determined by the shape of the color layer. Hybrid shapes are also advantageous, with the result that in one partial area the motif is determined by the punching and in a further partial area the motif is determined by the shape of the color layer.

Furthermore, it is advantageous if not only the motif is determined by the punching, but in the same operation the register marks are punched at the same time.

It is further advantageous that the transfer layer is completely severed by means of punching along a boundary line defining the at least one first zone of the transfer layer and separating the at least one first zone from the at least one second zone of the transfer layer.

The carrier layer is preferably less than 50% severed. Possible tearing during removal of the carrier layer is hereby prevented.

According to a further embodiment example of the invention, one or more transfer films according to the invention are used for application to a film, in particular with a first surface and a second surface.

It is further possible that the one or more transfer films are applied to the first surface and/or to the second surface of the film. For example, the application of the transfer layers of the transfer films can thus take place to one side of the film or also to two opposite sides of the film. It is also possible that the transfer films are applied to both sides of the film. It is thus possible to provide several, in particular differently constructed transfer films on one or both opposite sides of the film. For example, on one side of the film, transfer films with diffractive surface structures molded into a replication varnish layer and a reflecting layer can be provided, and on the opposite side of the film, transfer films with a color layer which comprises a binder and optically variable pigments.

It is further possible that at least one first transfer film of the one or more transfer films, which is applied to the first surface of the film, overlaps or does not overlap with at least one second transfer film of the one or more transfer films, which is applied to the second surface of the film.

It is further advantageous that the film is applied to a security document together with the one or more applied transfer films or introduced into a security document. Detachment of the one or more transfer films from the film does not take place here.

It is further possible that the one or more transfer layers of the one or more transfer films are applied to the film, wherein the film comprises further security features selected from the group of diffractive surface structures, in particular Kinegram® or holograms, zero-order diffraction structures, blazed gratings, a preferably linear or crossed sinusoidal diffraction grating, a linear or crossed single- or multi-step rectangular grating, an asymmetrical saw-tooth relief structure, a light-diffracting and/or light-refracting and/or light-focusing micro- or nanostructure, a binary or continuous Fresnel lens, a binary or continuous Fresnel freeform surface; diffractive or refractive macrostructures, lens structures, microprism structures, mirror surfaces and mat structures, in particular anisotropic or isotropic mat structures, or a combination structure of several of the above-named surface structures. The advantages, in particular with respect to the use of the stamping technique as application method in comparison with a printing process, can be utilized hereby. The film which comprises further security features can, for its part, in turn for example be applied to a security document by means of a stamping technique or by means of lamination or introduced into a security document, with the result that it is possible to extend existing security elements by application of the transfer layer of the transfer film according to the invention, or to further increase their protection against forgery.

It is further advantageous that one or more transfer films are applied to the second surface of the film with the side of the carrier layers facing away from the transfer layers of the one or more transfer films, and between the one or more transfer films and the film, a second bonding layer is applied, which connects the one or more transfer films to the film, wherein the bonding strength of the second bonding layer exceeds the bonding strength between the one or more transfer layers and the one or more carrier layers of the one or more transfer films or vice versa.

In the case that the bonding strength of the second bonding layer exceeds the bonding strength between the one or more transfer layers and the one or more carrier layers of the one or more transfer films, it is achieved that the one or more transfer films can be applied to a target substrate in a targeted manner. For this, transfer films are applied to a target substrate with the side facing away from the film, with the result that after pulling off the film, the transfer layers remain bonded to the target substrate. For example ready-made transfer layers can hereby be used for the protection of security documents which can be personalized for example with a photograph or other personal data.

In the opposite case, that the bonding strength of the second bonding layer is less than the bonding strength between the one or more transfer layers and the one or more carrier layers of the one or more transfer films, it is achieved, alternatively to the previously described variant, that the one or more transfer films can be applied, together with their carrier layers as self-supporting elements, to a target substrate in a targeted manner. For this, transfer films with their carrier layers are applied to a target substrate with the side facing away from the film, with the result that after pulling off the film, the transfer layers with their carrier layers remain bonded to the target substrate. For example ready-made self-supporting transfer layers can hereby be used for the protection of security documents which can be personalized for example with a photograph or other personal data.

The transfer film according to the invention can be applied to security documents, in particular banknotes, ID cards, check cards, credit cards, visas, certificates or vignettes or also to commercial products or product packaging.

It is further possible that security documents with one or more transfer films according to the Invention are produced or can be produced.

It is further possible that one or more transfer layers of the one or more transfer films according to the invention are arranged on a surface of a first carrier substrate made of paper or plastic, in particular of polycarbonate, PET, polypropylene, polyethylene or Teslin.

Preferably, the one or more transfer layers arranged on the surface of the first carrier substrate are connected, in particular laminated or adhesively bonded, to a plastic layer, in particular a polycarbonate layer or a PET layer.

BRIEF DESCRIPTION OF THE DRAWINGS

Embodiment examples of the invention are explained below by way of example with the aid of the attached figures.

DETAILED DESCRIPTION OF THE INVENTION

Figure 1:
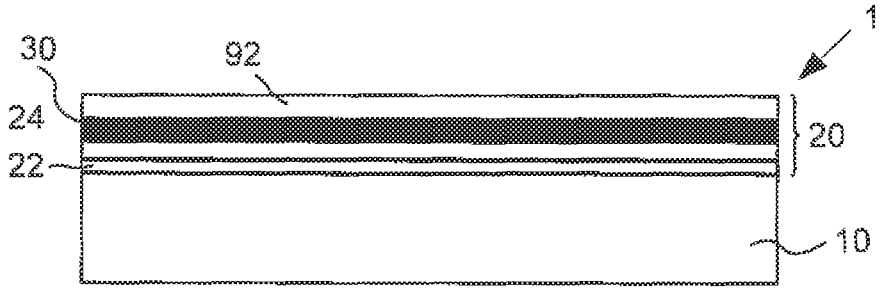
FIG. 1 shows a schematic sectional representation of a transfer film

FIG. 1 shows a transfer film 1 with a carrier layer 10, a wax layer 22 and a transfer layer 20, which comprises a detachment layer 24, a color layer 30 and a bonding layer 92.

The carrier layer 10 is preferably a PET, PEN, OPP, BOPP, PE or cellulose acetate film with a thickness between 12 μm and 50 μm. The carrier layer 10 shown in FIG. 1 is a PET film with a layer thickness of 19 μm.

The wax layer 22 and the transfer layer 20 are now applied to the carrier layer 10 successively, by applying further layers. The wax layer 22 here has a thickness of 10 nm. Typical layer thicknesses for the wax layer 22 lie in the range of from 1 nm to 100 nm. A detachment layer 24 with a thickness of from 0.2 μm to 2 μm is applied to the wax layer 22. The detachment layer 24 shown in FIG. 1 is a thermoplastic detachment layer 24 with a thickness of 0.95 μm. The wax layer 22, together with the detachment layer 24, ensures separation from the carrier layer 10. The detachment layer 24, in particular after transfer of the transfer layer 20, represents the top layer. Thus for example because of the heat occurring during a hot-stamping procedure, the wax layer is softened and a secure separation of the detachment layer 24 from the wax layer 22 is hereby achieved.

The color layer 30 is preferably an OVI layer with a thickness between 3 μm and 30 μm. The color layer 30 thus comprises a binder and pigments, the color appearance of which changes depending on the observation angle and in particular generates a color-change effect.

The pigments in the color layer 30 preferably have a diameter between 1 μm and 100 μm. The color-change effect of the pigments can appear for a human observer for example from green to brown or from green to violet. The pigments of the color layer 30 which produce such a color-change effect, are here preferably substantially similarly oriented to each other, with respect to the surface normal established by the plane spanned by the transfer layer 20. The orientation of the pigments with respect to each other can however be locally varied; for this the pigments can for example be magnetic.

It is also possible that the color layer 30 contains further pigments such as preferably flakes, charms, taggants, reflective pigments or pigments formed as flakes, which have a diffractive structure.

Furthermore, it is possible that the color layer 30 contains pigments which, in the case of irradiation with electromagnetic radiation, in particular irradiation with UV or IR light, emit light from the wavelength range visible to the human eye, in particular in the wavelength range from 400 nm to 800 nm. The color layer 30 can also contain for example soluble dyes which for example stain the color layer 30 corresponding to the added dyes. The color layer 30 shown in FIG. 1 has a layer thickness between 10 μm and 12 μm. The color layer 30 can for example be applied by means of a screen printing process.

The bonding layer 92 is then applied with a layer thickness of from approximately 2 μm to 8 μm. The bonding layer 92 shown in FIG. 1 has a layer thickness of 4.5 μm. The bonding layer 92 preferably consists of a thermally activatable adhesive and is applied to the layer 30 over the whole surface, for example by means of a doctor blade. It is here possible that the bonding layer has a compensating effect on the layer thickness of the color layer 30, if the latter comprises for example fluctuations in the layer thickness. The bonding layer 92 is preferably a layer made of acrylate, PVC, polyurethane or polyester.

The transfer layer 20 can for example be transferred onto a target substrate by means of hot stamping. Furthermore, it is possible to transfer the transfer layer 20 by means of cold transfer. A UV-curable adhesive can for example be used as bonding layer here. In the case of cold transfer, but also in the case of hot stamping, the bonding layer can preferably either be part of the transfer layer or also alternatively or additionally thereto be applied to the target substrate. The curing of the UV-curing adhesive can take place through the color layer, if the color layer exhibits sufficient transmission for UV light, or through the target substrate, if the target substrate is at least partially transparent to UV light. The latter applies in particular in the case of polymer substrates such as for example polycarbonate, polyester, polyethylene or polypropylene.

The bonding layer 92 can also be applied patterned to the target substrate, for example by a printing process. This process is suitable in particular in the case of application by means of cold transfer. However, it can also be used with thermally activatable adhesives in the case of hot stamping.

Figure 2A:
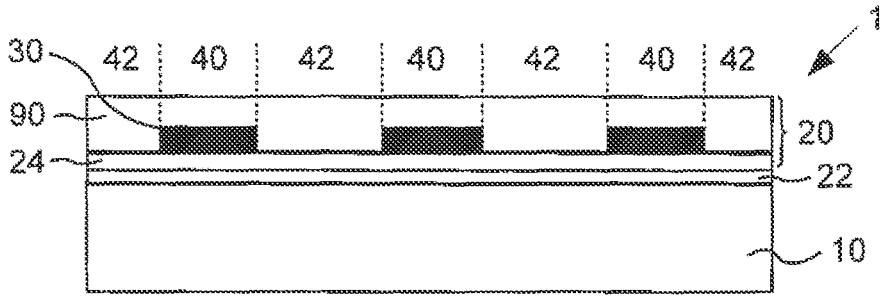
FIG. 2*a* to FIG. 2*c* show schematic representations to illustrate the use of a transfer film
Figure 2B:
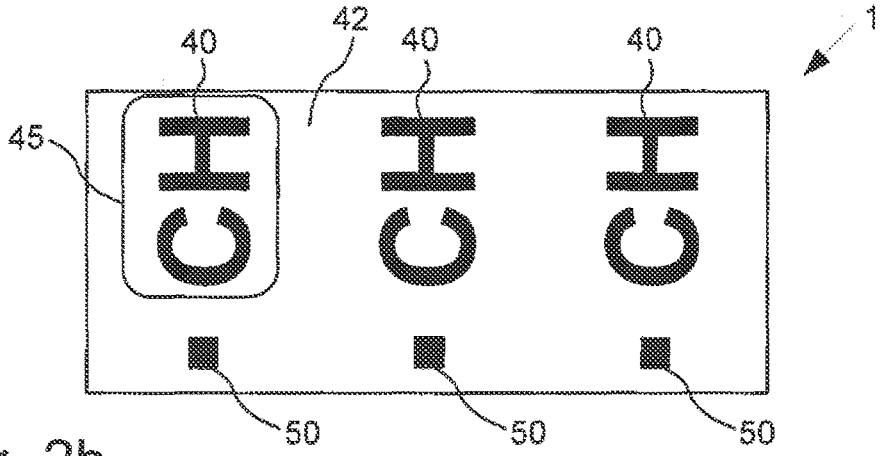
Figure 2C:
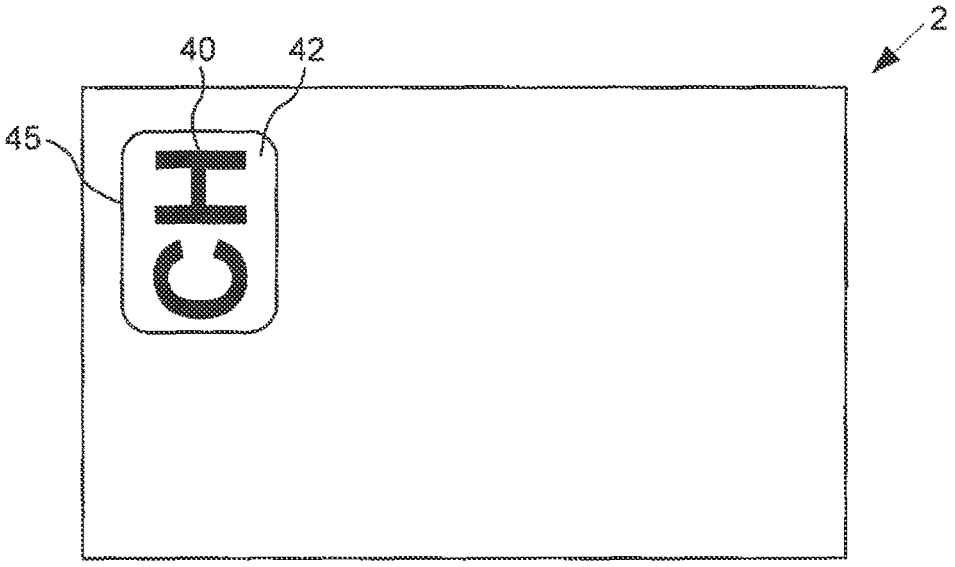

FIG. 2*a* to FIG. 2*c* illustrate the use of a transfer film 1 according to a further embodiment example of the invention. FIG. 2*a* shows a transfer film 1 with a carrier layer 10, a wax layer 22 and a transfer layer 20, which comprises a detachment layer 24, a color layer 30 and a compensation layer 90.

In the embodiment example of FIG. 2*a*, the transfer layer 20 has three areas 40 and four areas 42 surrounding the areas 40. The number of areas 40 and areas 42 is selected here purely by way of illustration. It is thus possible that for example only one area 40 and one area 42 are present or that a plurality of areas 40 and areas 42 are present. The areas 40 here represent the part of the transfer layer 20 which has the color layer 30.

The compensation layer 90 is preferably a layer made of acrylate, PVC, polyurethane or polyester with a layer thickness between 2 μm and 50 μm. The compensation layer 90 in FIG. 2*a* is thus a bonding layer as explained in FIG. 1, which overlaps the color layer 30 applied in the areas 40 and fills in the areas 42. The compensation layer 90 in FIG. 2*a* has a layer thickness of 25 μm.

It is however also possible that the compensation layer 90 is also present in a smaller layer thickness, in particular in a layer thickness smaller than the color layer 30, whereby the areas 40 and 42 are overlapped, and the areas 42 are only covered, but not filled in.

Furthermore, it is possible that the compensation layer 90 is a layer made of polymethyl acrylate, dipentaerythriol pentaacrylates or polysiloxane resin, which comprises a photoinitiator such as for example Irgacure and can be cross-linked by means of UV light. Alternatively, the compensation layer can consist of acrylate, polyester, polyvinyl alcohols or alkyd resins and be chemically cross-linked by means of isocyanate. In such a case, the transfer layer would in addition have a bonding layer which is applied to the compensation layer 90. With respect to the embodiment of such a bonding layer, reference is made here to the statements of FIG. 1.

FIG. 2*b* now shows the top view of the transfer film 1 of FIG. 2*a*. As shown in FIG. 2*b*, the color layer 30 is here applied patterned in the form of the letters "CH" in the areas 40. Furthermore, in three areas 43, marks 50 are applied, which serve to determine the areas 40. The marks 50 represent register marks or registration marks, using which the accurately positioned arrangement of layers that are superimposed or juxtaposed relative to one another, maintaining a desired positional tolerance, can be recognized.

With respect to the embodiment of the carrier layer 10, the wax layer 22, the detachment layer 24 and the color layer 30 reference is made here to the statements of FIG. 1.

FIG. 2*c* now shows the top view of a security document 2, to which an area 45 of the transfer layer 20 of FIG. 2*a* and FIG. 2*b* is applied. The security document 2 is a security document made of polycarbonate. The area 45 of the transfer layer 20 which comprises one of the areas 40 and a partial area of the areas 42 is for example transferred by hot stamping onto the security document 2 by means of a hot embossing stamp. The shape of the area 45 is determined by the stamp shape of the hot embossing stamp. The transfer takes place for example by optical detection of one of the marks 50 by means of an optical sensor, which detects the marks 50, for example because of their opacity in comparison with the areas 42, and then controls the application of the area 45 of the transfer layer 20 by means of the embossing stamp. In FIG. 2*c*, the area 45 of the transfer layer 20 is now applied to the security document 2, with the result that the security document 2 now has the letters "CH" having a color-change effect.

FIG. 3*a* to FIG. 6*b* show different embodiment variants of the transfer film 1 according to the invention. FIG. 3*a*, FIG. 4*a*, FIG. 5*a* and FIG. 6*a* show the different embodiment variants of the transfer film 1 before separation of the transfer layers 20 and FIG. 3*b*, FIG. 4*b*, FIG. 5*b* and FIG. 6*b* show the corresponding embodiment variants after separation of the transfer layers 20.

Figure 3A:
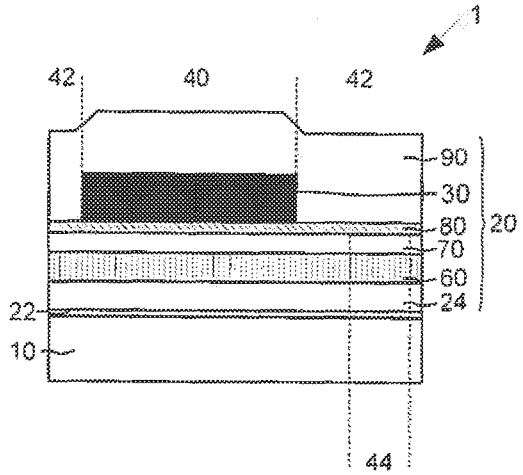
FIG. 3*a* to FIG. 6*b* show schematic sectional representations of transfer films
Figure 3B:
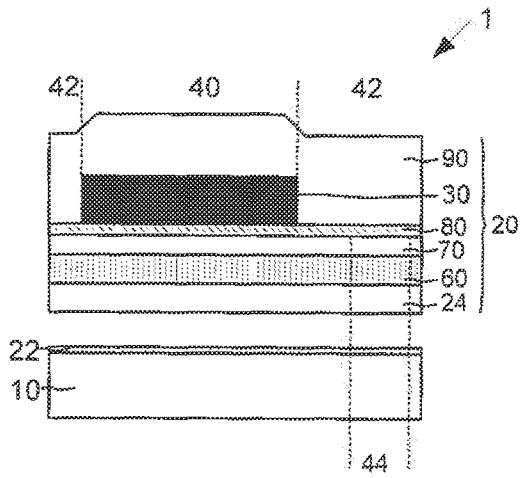

In the embodiment example shown in FIG. 3*a* the transfer film 1 comprises a carrier layer 10, a wax layer 22 and a transfer layer 20, which comprises a detachment layer 24, a stabilizing layer 60, a replication varnish layer 70, a primer layer 80, a color layer 30 and a compensation layer 90.

The stabilizing layer 60 is preferably a layer made of acrylate, polyester, polyvinyl alcohols or alkyd resins, which is chemically cross-linked for example by means of isocyanate. Furthermore, layers made of polymethyl acrylate, dipentaerythriol pentaacrylates or polysiloxane resin, which are provided with a photoinitiator such as for example Irgacure, can for example be used. Such a stabilizing layer can be cross-linked through the photoinitiator by irradiation by means of UV light. The stabilizing layer 60 preferably has a layer thickness between 0.2 μm and 5 μm. The stabilizing layer shown in FIG. 3*a* is a chemically cross-linked stabilizing layer with a thickness of approximately 0.7 μm.

The replication varnish layer 70 consists of a thermoplastic lacquer into which a surface structure is molded by means of heat and pressure by the action of a stamping tool. It is further also possible that the replication varnish layer 70 is formed by a UV-cross-linkable lacquer and the surface structure is molded into the replication varnish layer 60 by means of UV replication. The surface structure is molded onto the uncured replication varnish layer by the action of a stamping tool and the replication varnish layer is cured directly during or after the molding by irradiation with UV light.

The replication varnish layer 70 preferably has a layer thickness between 0.2 μm and 2 μm. The layer thickness of the replication varnish layer 70 in FIG. 3*a* is 0.5 μm and it is an at least partially chemically cross-linked replication varnish layer. The surface structure molded into the replication varnish layer 70 is preferably a diffractive surface structure, for example a hologram, Kinegram® or another optically diffractive active grating structure. Such surface structures typically have a spacing of the structural elements in the range of from 0.1 μm to 4 μm. It is further also possible that the surface structure is a zero-order diffraction structure, a blazed grating, a preferably linear or crossed sinusoidal diffraction grating, a linear or crossed single- or multi-step rectangular grating, an asymmetrical saw-tooth relief structure, a light-diffracting and/or light-refracting and/or light-focusing micro- or nanostructure, a binary or continuous Fresnel lens, a binary or continuous Fresnel freeform surface; a diffractive or refractive macrostructure, in particular lens structure or microprism structure, a mirror surface or mat structure, in particular anisotropic or isotropic mat structure, or a combination structure of several of the above-named surface structures. The surface structures molded into the replication varnish layer 70 are, in FIG. 3*a*, molded into an area 44 which is surrounded by the areas 42, and is thus present in the case of perpendicular observation of the transfer film next to the areas 40 comprising the color layer.

It is further possible that a reflecting layer is applied to the replication varnish layer 70. The reflecting layer is preferably a metal layer made of chromium, gold, copper, silver or an alloy of such metals, which is vapor-deposited in a layer thickness of from 0.01 μm to 0.15 μm under vacuum. It is further also possible that the reflecting layer is formed by a transparent reflecting layer, for example a thin or finely structured metallic layer or an HRI (high refraction index) or LRI (low refraction index) layer. Such a dielectric reflecting layer consists, for example, of a vapor-deposited layer made of a metal oxide, metal sulfide, titanium oxide etc. of a thickness of from 10 nm to 150 nm.

The primer layer 80 is a layer which preferably comprises acrylates, PVC, polyurethane or polyester and has a layer thickness between 0.01 μm and 0.5 μm. The primer layer shown in FIG. 3*a* has a layer thickness of 0.06 μm.

With respect to the embodiment of the further layers in FIG. 3*a*, reference is made here to the above statements.

Figure 4A:
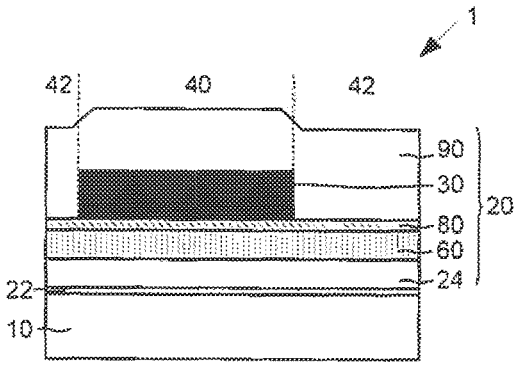
Figure 4B:
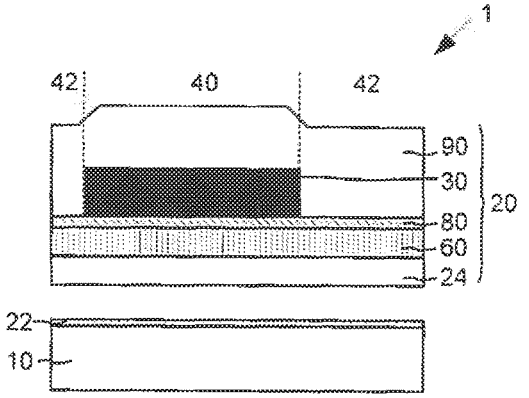

The transfer film 1 of the embodiment example of FIG. 4*a* corresponds to the transfer film 1 of the embodiment example of FIG. 3*a* with the difference that the transfer film according to FIG. 4*a* has no replication varnish layer.

Figure 5A:
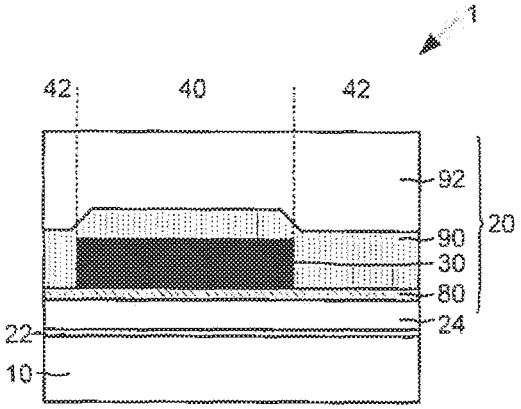
Figure 5B:
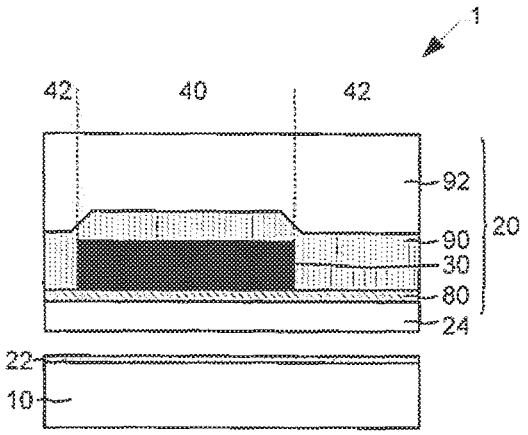

The transfer film 1 of the embodiment example of FIG. 5*a* corresponds to the transfer film 1 of the embodiment example of FIG. 4*a* with the difference that the compensation layer 90 is formed as a stabilizing layer and the transfer layer 20 additionally has a bonding layer 92. For this, the compensation layer 90 is formed from the material of the stabilizing layer as described above and the stabilizing layer 60 between the detachment layer 24 and the primer layer 80, as shown in FIG. 4*a*, is removed. With respect to the embodiment of the bonding layer 92, reference is made here to the above statements.

Figure 6A:
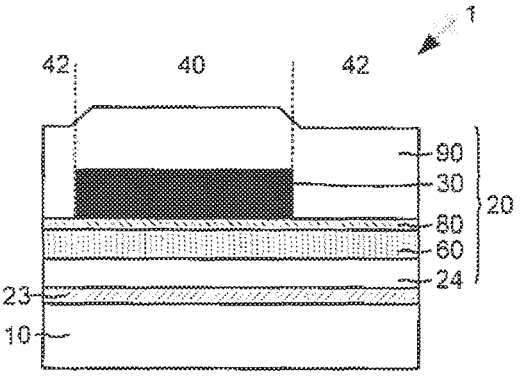
Figure 6B:
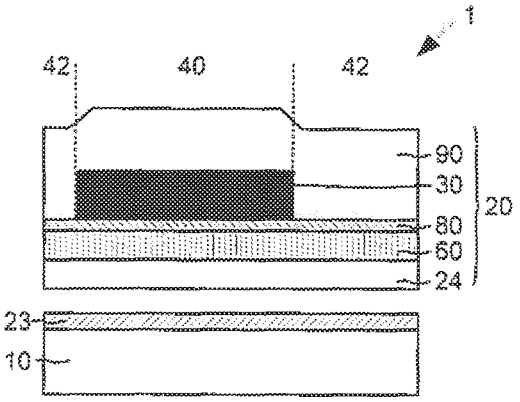

The transfer film 1 of the embodiment example of FIG. 6*a* corresponds to the transfer film 1 of the embodiment example of FIG. 4*a* with the difference that the wax layer 22 has been replaced with a varnish layer 23 that can be cured by means of UV light or electron beams.

Figure 7A:
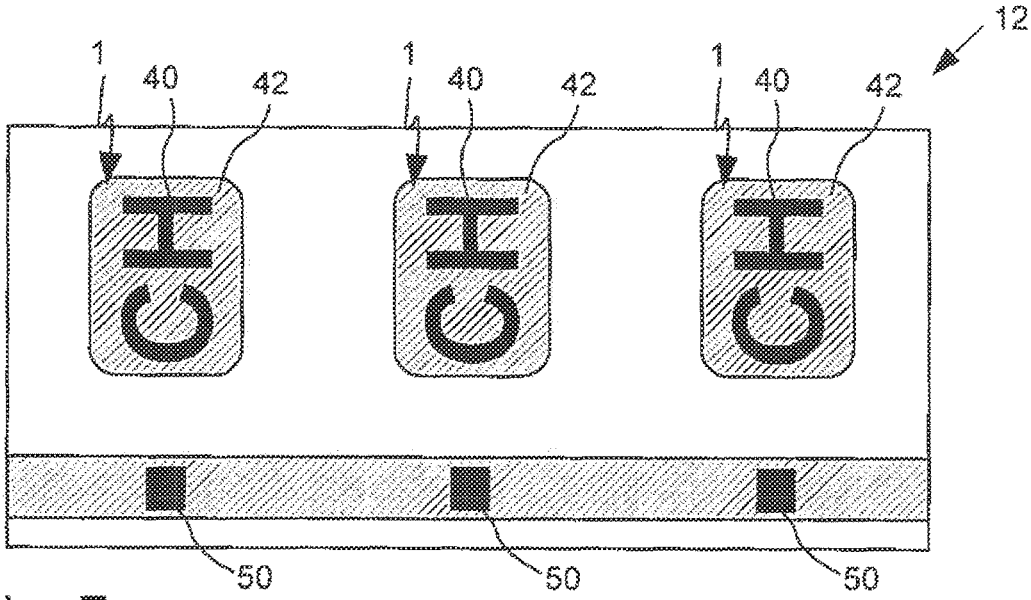
FIG. 7*a* and FIG. 7*b* show schematic representations to illustrate the use of a transfer film
Figure 7B:
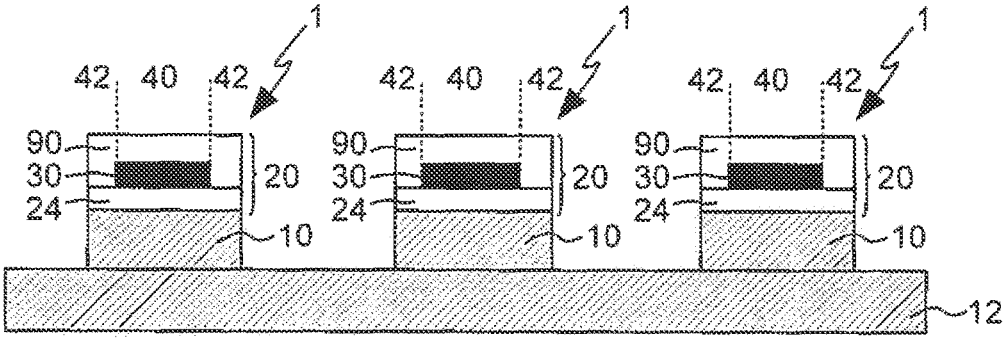

FIG. 7*a* and FIG. 7*b* illustrate the use of a transfer film 1 on a further film 12. FIG. 7*a* shows a top view of a film 12, FIG. 7*b* a cross-section of the film 12. As can be seen in FIG. 7*b*, one or more transfer films 1 are applied to the film 12. The one or more transfer films 1 are connected to the carrier layers 10 with the film 12 by a bonding layer. The transfer layers 20, which comprise the detachment layers 24, the color layers 30 and the compensation layers 90, are applied to the carrier layers 10 of the one or more transfer films 1. As can be seen in FIG. 7*a*, the film 12 has marks 50 which can preferably be formed as a rectangle, lines or stripes and run transverse to the longitudinal direction of the film web which forms the film 12. The one or more transfer films 1 applied to the film 12 can now be applied to a target substrate. If the film 12 is removed, the transfer layers 20 separate from the carrier layers 10 of the one or more transfer films 1 and the transfer layers are transferred onto the target substrate corresponding to their arrangement on the film 10. The carrier layers 10 of the one or more transfer films 1 remain on the film 12.

It can also be provided that the arrangement of the bonding layer between the carrier layers 10 and the film 12 as well as of the detachment layer 24 between the carrier layers 10 and the transfer layers 20 is reversed. Thus, a detachment layer is arranged in each case between the film 12 and the carrier layers 10, and the carrier layers 10 are connected to the transfer layers 20 in each case by a bonding layer. This has the effect that, during application to a target substrate, the carrier layers 10 of the film 12 are transferred together with the transfer layers 20, and thus the carrier layers 10 become part of the transfer layers 20. Consequently self-supporting small areas are transferred through the carrier layers 10. The mechanical stability of the transfer layers 20 is increased by the carrier layers 10 also transferred.

Figure 8A:
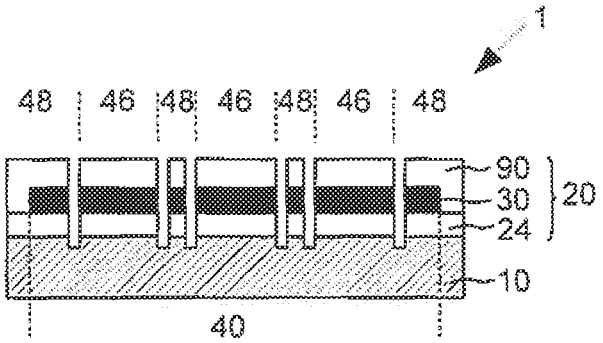
FIG. 8*a* and FIG. 8*b* show schematic sectional representations of a transfer film
Figure 8B:
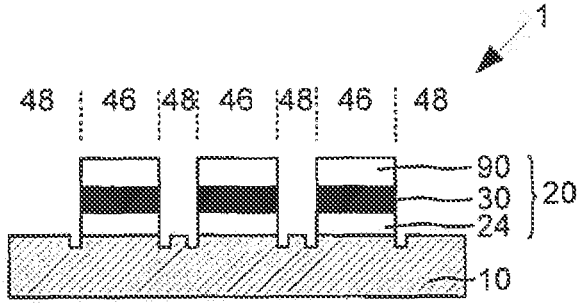

FIG. 8*a* and FIG. 8*b* show sectional representations of a transfer film according to a further embodiment example of the invention. The transfer film 1 of FIG. 8*a* and FIG. 8*b* consists of a carrier layer 10, and a transfer layer 20, which comprises a detachment layer 24, a color layer 30 and a compensation layer 90. With respect to the embodiment of the layers, reference is made here to the above statements. As shown in FIG. 8*a*, the transfer layer 20 of the transfer film 1 is severed along the boundary line formed by three zones 46 and four zones 48. The transfer layer 20 is preferably severed by means of punching. The punching can take place by means of a mechanical tool or by means of a laser. As shown in FIG. 8*a*, the area 40 which comprises the color layer 30 surrounds each of the three zones 46. The shape of the punch thus predefines the shape of the zones 46. The number of zones 46 and zones 48 is selected here purely by way of illustration. It is thus possible that for example only one zone 46 and one zone 48 are present or that a plurality of zones 46 and zones 48 are present. As shown in FIG. 8*b*, the transfer layers 20 can be removed from the zones 48, with the result that only the transfer layers 20 of the zones 46 remain on the carrier layer 10. The latter can then be transferred onto a target substrate for example by means of a stamping process.

Figure 9A:
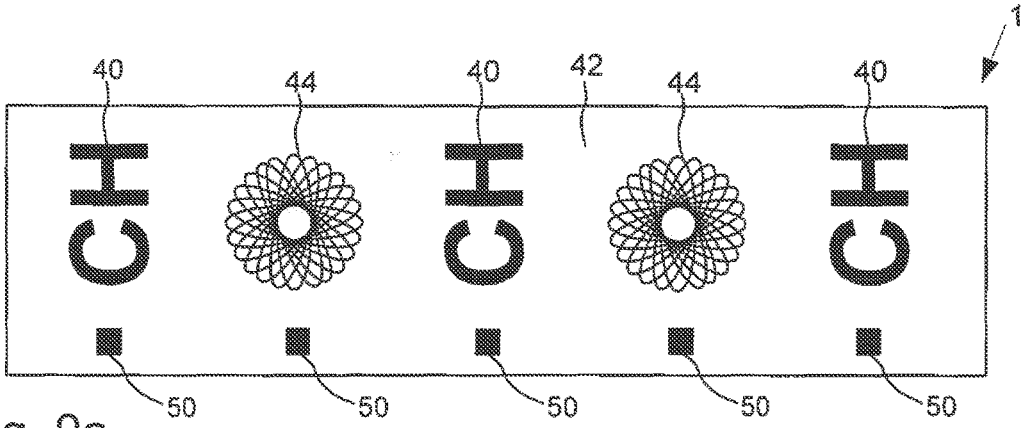
FIG. 9*a* to FIG. 9*c* show schematic top views of a transfer film
Figure 9B:
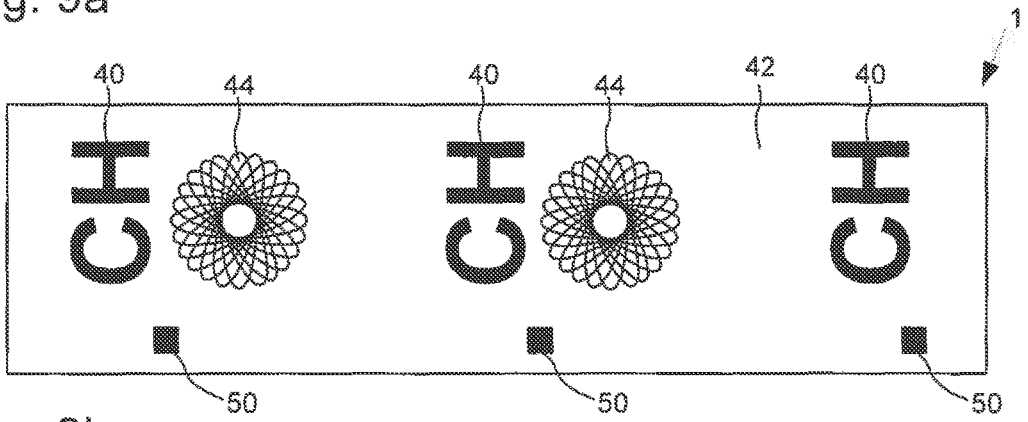
Figure 9C:
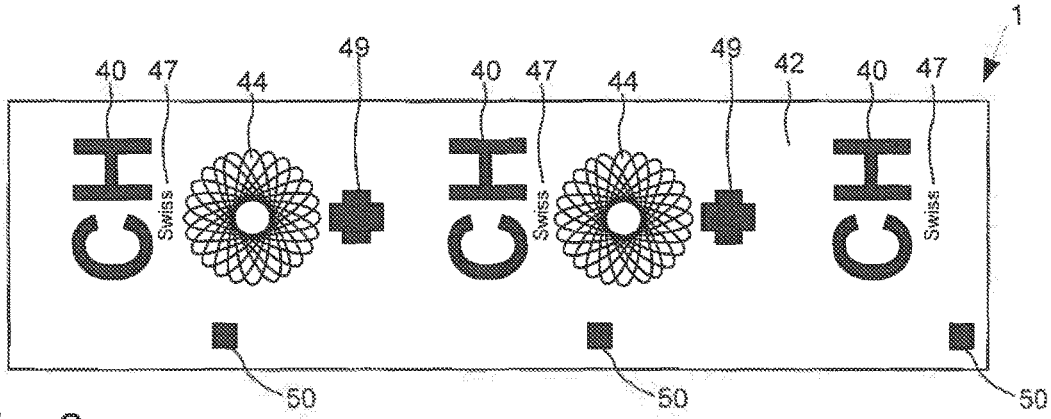

FIG. 9*a* and FIG. 9*c* show schematic top views according to a further embodiment of the invention.

FIG. 9*a* shows a transfer film 1 which has a color layer in three areas 40 and a Kinegram® in the areas 44 in each case. The areas 44, as shown in FIG. 9*a*, lie within the area 42 in which no color layer is applied. The color layer is here applied in the form of the letters "CH" in the areas 40 within the transfer layers, and the Kinegram® elements are stamped into a replication varnish layer of the transfer layers, in the form of a pattern in the areas 44. Furthermore, in areas 43, marks 50 are applied, which serve to determine the relative position of the areas 40 and 44. As can be seen in FIG. 9*a*, each security feature thus has, in each case, a separate mark 50 in the form of the areas 40 forming the letters "CH" and the areas 44 forming the Kinegram® elements. It is hereby possible that the letters "CH" which form a first security feature and the Kinegram® elements which form a second security feature can be detected and stamped separately. This can take place, for example, with two different embossing stamps.

The transfer film 1 of the embodiment example of FIG. 9*b* corresponds to the transfer film 1 of the embodiment example of FIG. 9*a* with the difference that the areas 40 which form the letters "CH" and the areas 44 which comprise the Kinegram® elements together have a common mark 50. In each case one of the areas 40 comprising the color layer and the area 44 comprising a Kinegram® is hereby detected and stamped jointly. This can take place, for example, with one common embossing stamp.

The transfer film 1 of the embodiment example of FIG. 9*c* corresponds to the transfer film 1 of the embodiment example of FIG. 9*b* with the difference that within the area 42 in which no color layer is applied, further areas 47 and 49 are present. The areas 47 are metalized areas 47 in the form of the logo "Swiss". Furthermore, it is for example possible that the logo is designed as nanotext and thus is not visible to the naked human eye. Furthermore, the transfer film has a second color layer in the form of a cross in the areas 49. The transfer film 1 thus has a first color layer in the areas 40 and a second color layer in the areas 49. The pigments of the first and second color layer preferably differ, with the result that different color effects can be perceived in the first areas 40 and areas 49.

Figure 10:
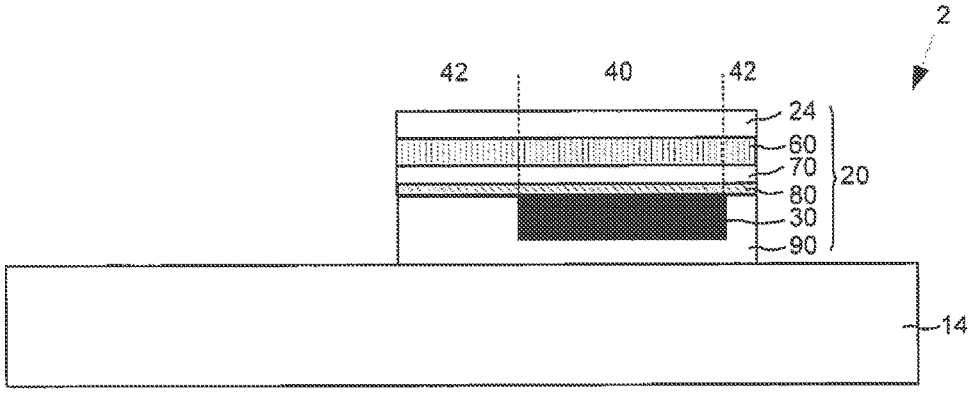
FIG. 10 shows a schematic sectional representation of a security document to illustrate the use of a transfer film

FIG. 10 shows a schematic sectional representation of a security document 2, to which a transfer layer 20 of a transfer film 1 according to the invention is applied. The transfer layer 20 is applied to a carrier substrate 14. The carrier substrate 14 can for example be a paper-based carrier substrate 14, such as for example a passport, a visa, a banknote or a certificate. It is also possible that the carrier substrate 14 is a plastic substrate, such as for example polycarbonate, PVC, PET, or PET-G. The carrier substrate 14 can likewise be a hybrid substrate made of paper and plastic layers, wherein either a paper layer or a plastic layer forms the outermost layer to which the transfer layer 20 is applied. The transfer layer 20 has a detachment layer 24, a stabilizing layer 60, a replication varnish layer 70, a primer layer 80, a color layer 30 and a compensation layer 90. With respect to the embodiment of the layers, reference is made here to the above statements.

Figure 11:
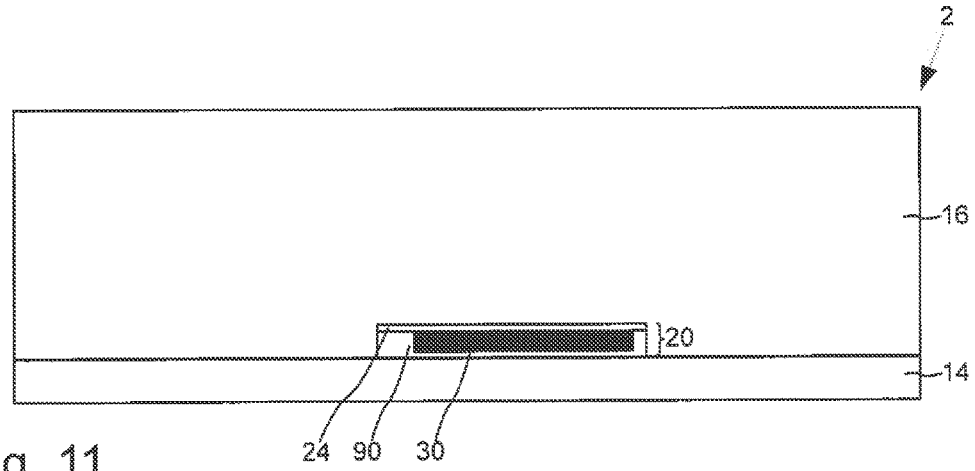
FIG. 11 shows a schematic sectional representation of a security document to illustrate the use of a transfer film

FIG. 11 shows a schematic sectional representation of a security document 2, into which a transfer layer 20 of a transfer film 1 according to the invention is laminated. The transfer layer 20 is applied to a carrier substrate 14 made of plastic, such as for example polycarbonate. The carrier substrate 14 is then laminated with one or more further plastic layers 16 to form a composite. The transfer layer 20 has a detachment layer 24, a color layer 30 and a compensation layer 90. With respect to the embodiment of the layers, reference is made here to the above statements.

LIST OF REFERENCE NUMBERS

1 transfer film
2 security document
10 carrier layer
12 film
14 carrier substrate
16 plastic layer
20 transfer layer
22 wax layer
24 detachment layer
30 color layer
40, 42, 43, 44, 45 47, 49 areas
46,48 zones
50 mark
60 stabilizing layer
70 replication varnish layer
80 primer layer
90 compensation layer
92 bonding layer

The invention claimed is:

1. A transfer film comprising a transfer layer detachably arranged on a carrier layer, wherein the transfer layer has at least one first color layer, and wherein the at least one first color layer comprises at least one binder and at least first pigments, the color appearance of which changes depending on the observation angle, wherein the at least one first color layer is present in at least one first area of the transfer layer and no color layer is present in at least one second area of the transfer layer, wherein the transfer layer has a first compensation layer which covers the at least one first area of the transfer layer and covers the at least one second area of the transfer layer, and wherein the transfer layer further comprises:

at least one replication varnish layer disposed between the first color layer and the carrier layer;

a primer layer disposed between the first color layer and the at least one replication varnish layer; and at least one first stabilizing layer disposed between the at least one replication varnish layer and the carrier layer.

2. The transfer film according to claim 1, wherein the at least one first area represents a first item of information in the form of a pattern, motif or a logo.

3. The transfer film according to claim 1, wherein the first compensation layer has a layer thickness between 3 μm and 50 μm.

4. The transfer film according to claim 1, wherein the first compensation layer is transparent and/or colorless.

5. The transfer film according to claim 1, wherein the first compensation layer is formed as a bonding layer.

6. The transfer film according to claim 1, wherein the at least one first color layer has a thickness between 3 μm and 30 μm.

7. The transfer film according to claim 1, wherein the at least one first stabilizing layer mechanically stabilizes the transfer layer.

8. The transfer film according to claim 7, wherein the at least one first stabilizing layer has a layer thickness between 0.2 μm and 7.5 μm.

9. The transfer film according to claim 7, wherein the at least one first stabilizing layer is cross-linked chemically and/or by irradiation with UV light and/or irradiation with electron beams.

10. The transfer film according to claim 7, wherein the at least one first stabilizing layer is a layer cured by electromagnetic radiation.

11. The transfer film according to claim 7, wherein the at least one first stabilizing layer is transparent or translucent.

12. The transfer film according to claim 1, wherein the carrier layer has a layer thickness between 12 μm and 50 μm.

13. The transfer film according to claim 1, wherein the transfer layer comprises a detachment layer which allows the separation of the transfer layer from the carrier layer.

14. The transfer film according to claim 13, wherein the detachment layer has a layer thickness between 0.2 μm and 4 μm.

15. The transfer film according to claim 1, wherein the carrier layer comprises a separating layer curable by means of UV light or electron beams, which allows the separation of the transfer layer from the carrier layer.

16. The transfer film according to claim 1, wherein the at least one first color layer is applied to the primer layer.

17. The transfer film according to claim 16, wherein the primer layer has a layer thickness between 0.01 μm and 0.5 μm.

18. The transfer film according to claim 1, wherein a surface structure is molded into the surface of the replication varnish layer.

19. The transfer film according to claim 18, wherein the surface structure is not molded into the surface of the replication varnish layer in the at least one first area of the transfer layer.

20. The transfer film according to claim 18, wherein the refractive index of the replication varnish layer differs from the refractive index of the binder by less than 0.2.

21. The transfer film according to claim 18, wherein the surface structure is selected from the group of diffractive surface structures, Kinegram or holograms, zero-order diffraction structures, blazed gratings, linear or crossed sinusoidal diffraction gratings, linear or crossed single- or multi-step rectangular gratings, asymmetrical saw-tooth relief structures, light-diffracting and/or light-refracting and/or light-focusing micro- or nanostructures, binary or continuous Fresnel lenses, binary or continuous Fresnel freeform surfaces, diffractive or refractive macrostructures, structures or microprism structures, mirror surfaces and mat structures, anisotropic or isotropic mat structures, or combinations of these structures.

22. The transfer film according to claim 18, wherein the surface structure of the transfer layer represents a second item of information in the form of a pattern, motif or a logo.

23. The transfer film according to claim 1, wherein the replication varnish layer is thermoplastically deformable and/or is cross-linked by irradiation with UV light.

24. The transfer film according to claim 1, wherein the replication varnish layer has a layer thickness between 0.2 μm and 4 μm.

25. The transfer film according to claim 1, wherein the transfer layer has a reflecting layer, wherein the surface coverage of the reflecting layer is less than 30% of the total surface area of the transfer layer.

26. The transfer film according to claim 25, wherein the reflecting layer represents a third item of information in the form of a pattern, motif or a logo.

27. The transfer film according to claim 1, wherein the transfer layer contains at least one mark for determining the at least one first area of the transfer layer.

28. The transfer film according to claim 1, wherein the first pigments have a diameter between 1 μm and 100 μm and a thickness between 0.1 μm and 5 μm.

29. The transfer film according to claim 1, wherein the at least one first color layer contains second pigments.

30. The transfer film according to claim 29, wherein the at least one first color layer contains third pigments which, in the case of irradiation with electromagnetic radiation emit light from the wavelength range visible to the human eye.

31. The transfer film according to claim 1, wherein the proportion of the at least first pigments in the at least one binder of the at least one first color layer is less than 50%.

32. The transfer film according to claim 1, wherein the at least one first color layer contains soluble dyes in the at least one binder.

33. The transfer film according to claim 1, wherein the first pigments are formed as flakes and exhibit a substantially similar orientation to each other with respect to the surface normal established by the plane spanned by the transfer layer.

34. The transfer film according to claim 1, wherein the orientation of the first pigments with respect to the surface normal established by the plane spanned by the transfer layer and a coordinate system spanned by the transfer layer is locally varied.

35. The transfer film according to claim 1, wherein the first pigments are magnetic and/or have one or more metal layers.

36. The transfer film according to claim 1, wherein the transfer layer is present in at least one first zone and is not present in at least one second zone, wherein the first zones of the transfer layer are formed patterned.

37. A method for applying a transfer film to a film with a first surface and a second surface, the method comprising: applying one or more transfer films according to claim 1 to the second surface of the film with the side of the carrier layers facing away from the transfer layers of the one or more transfer films, and; applying a bonding layer between the one or more transfer films and the film, the bonding layer connecting the one or more transfer films to the film, wherein the bonding strength of the bonding layer exceeds the bonding strength between the one or more transfer layers and the one or more carrier layers of the one or more transfer films or vice versa.

38. A security document comprising one or more transfer films according to claim 1.

39. The security document according to claim 38, wherein one or more transfer layers of the one or more transfer films are arranged on a surface of a first carrier substrate made of paper or plastic.

40. The security document according to claim 39, wherein the one or more transfer layers arranged on the surface of the first carrier substrate are laminated or adhesively bonded, to a polycarbonate layer.

* * * * *